US006957987B2

(12) United States Patent
Ma et al.

(10) Patent No.: US 6,957,987 B2
(45) Date of Patent: Oct. 25, 2005

(54) SOCKET CONNECTOR FOR INTEGRATED CIRCUIT

(75) Inventors: Hao-Yun Ma, Tu-Chen (TW); Ming-Lun Szu, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/998,858

(22) Filed: Nov. 29, 2004

(65) Prior Publication Data

US 2005/0124198 A1 Jun. 9, 2005

(30) Foreign Application Priority Data

Dec. 5, 2003 (TW) ..... 92221438 U

(51) Int. Cl.[7] ..... H01R 13/40
(52) U.S. Cl. ..... 439/733.1; 439/331; 439/83
(58) Field of Search ..... 439/83, 331, 733.1, 439/869

(56) References Cited

U.S. PATENT DOCUMENTS 4,693,528 A * 9/1987 Asick et al. ..... 439/83
4,968,263 A * 11/1990 Silbernagel et al. ..... 439/246
5,320,549 A * 6/1994 Schempp et al. ..... 439/246
5,387,138 A * 2/1995 O'Malley ..... 439/751
6,371,784 B1 * 4/2002 Scholz et al. ..... 439/342

* cited by examiner

*Primary Examiner*—Renee Luebke
*Assistant Examiner*—James R. Harvey
(74) *Attorney, Agent, or Firm*—Wei Te Chung

(57) ABSTRACT

A socket connector (1) includes an insulative housing (2) and a plurality of terminals (7) received in the housing. The housing defines a plurality of passageways (24) for accommodating the corresponding terminals. Each passageway forms a step (248) therein for dividing the passageway into a receiving channel (246) and an interfering channel (242). Each terminal defines a fastening portion (70) for securing the terminal in the passageway and the fastening portion forms a pair of straight interfering sides (710). The distance from one of two straight interfering sides to the other is greater than the width of the interfering channel. When the terminal is installed into the housing, the terminal is firmly positioned in corresponding passageway by virtue of the interfering force between the two straight interfering sides and the interfering channel.

4 Claims, 5 Drawing Sheets

SOCKET CONNECTOR FOR INTEGRATED CIRCUIT

BACKGROUND OF THE INVENTION

1. Field of the Invention

The present invention relates to a socket connector for electrically connecting an integrated circuit to a printed circuit board, especially for connecting a land grid array socket connector to a printed circuit board.

2. Description of the Prior Art

Modern computer systems increase in performance and complexity at a very rapid pace, driven by intense competition and market demands. In order to meet ever-increasing performance requirements, the area and volumetric interconnect densities of electronic board assemblies must increase accordingly. In combination with other competitive forces, this demand has driven the need for improved high-density socket technologies in computer applications, and the connector industry has responded with a variety of new alternatives to meet these needs. One of the most attractive of the new connector types is the land grid array (LGA) socket connector, which permits direct electrical connection between an LGA integrated circuit and a printed circuit board. LGA socket connectors are an evolving technology in which an interconnection between mating surfaces of an IC or other area array device and a printed circuit board is provided through a conductive terminal received in the socket connector. Connection is achieved by mechanically compressing the IC onto the socket connector.

FIGS. 4–5 disclose a conventional socket connector 90 for electrically connecting an integrated circuit (IC) package 91 to a printed circuit board (PCB) 92. The conventional socket connector 90 comprises a plurality of contact terminals 93 received in an insulative housing 94, a stiffening body 95 surrounding the housing 94, a load plate 96 pivotably assembled with one end of the stiffening body 95 and a load lever 97 pivotably attached to the other end of the stiffening body 95. The housing 94 defines a recessed area 940 for receiving the IC package 91 therein and the recessed area 940 has a bottom wall 941. The housing 94 defines a multiplicity of arrayed passageways 942 through the bottom wall 941. Each passageway 942 forms an upper receiving channel 943 and a lower interfering channel 944. The interfering channel 944 is narrower than the receiving channel 943 and a step 946 is accordingly formed therebetween. Each terminal 93 includes a fastening portion 930 defining a pair of shoulders 931 at a top portion thereof. The fastening portion 930 further defines a plurality of protrusions 932 for interfering with the interfering channel 944. When the terminal 93 is installed into the housing 94, the shoulders 931 are secured in the receiving channel 943 and abut against the step 946, and the fastening portion 930 is interferentially received in the interfering channel 944. Each terminal 93 further includes a solder portion 933 extending from and substantially perpendicular to the fastening portion 930. A solder ball 934 is attached to the solder portion 933 for mechanically connecting the connector 90 on the PCB 92 by surface mounting technology (SMT).

However, when the connector 90 is shaken by an improper exterior force, the housing moves upwardly relative to the PCB 92, and the step 946 acts on the shoulders 931 directly. As the terminal 93 is soldered on the PCB 92, the force acted on the shoulders 931 by the step 946 will break the connection between the solder ball 934 and the PCB 92, and the connection between the solder ball 934 and the solder portion 933. As a result, the conventional socket connector cannot provide reliable connection between the IC package 91 and the PCB 92.

Hence, a new socket connector which overcomes the above-described disadvantages is desired.

SUMMARY OF THE INVENTION

Accordingly, a primary object of the present invention is to provide a socket connector which has reliable structure and can perform reliable electrical connection between an integrated circuit and a printed circuit board.

In order to achieve the above-mentioned object, a socket connector in accordance with a preferred embodiment of the present invention comprises an insulative housing and a plurality of terminals received in the housing. The housing defines a plurality of passageways for accommodating the corresponding terminals. Each passageway forms a step therein for dividing the passageway into an upper receiving channel and a lower interfering channel. Each terminal defines a fastening portion for securing the terminal in the passageway and the fastening portion forms a pair of straight interfering sides. The distance from one of two straight interfering sides to the other is greater than the width of the interfering channel but smaller than the width of the receiving channel. When the terminal is installed into the housing via the corresponding passageway, the terminal is firmly positioned in corresponding passageway by virtue of the interfering force between the two straight interfering sides and the interfering channel. As the terminal is interferingly positioned in the passageway by the two straight interfering sides and the interfering channel, the interfering force is pure friction. While the housing is shaken by an improper exterior force, the terminal can slide smoothly in the passageway once the pure friction is conquered, which can protect the connection between the solder ball and the PCB and the connection between the solder portion and the solder ball.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
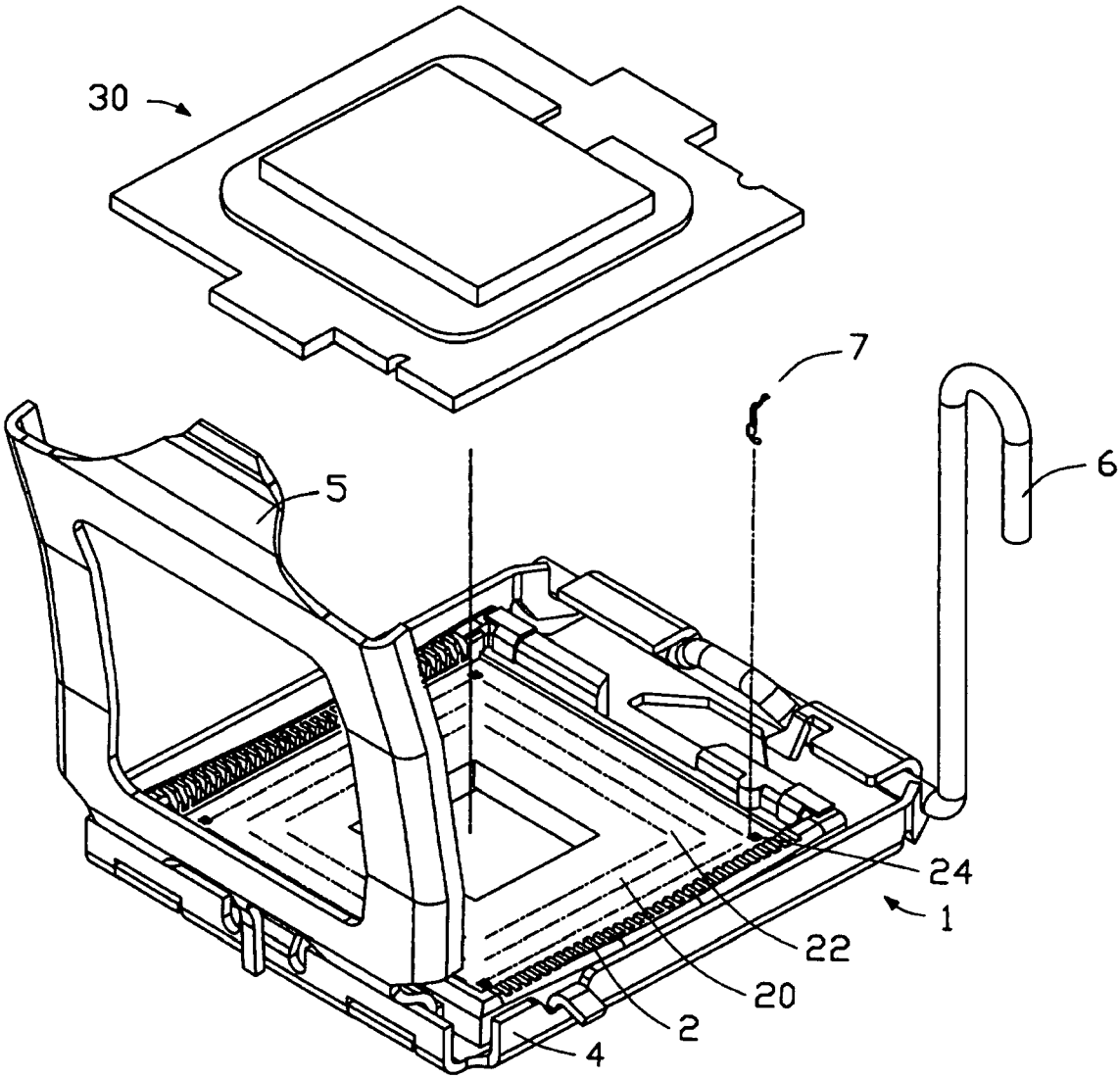
FIG. 1 is an isometric view of a socket connector in accordance with a preferred embodiment of the present invention, shown with an integrated circuit ready to be mounted onto the connector.
Figure 3:
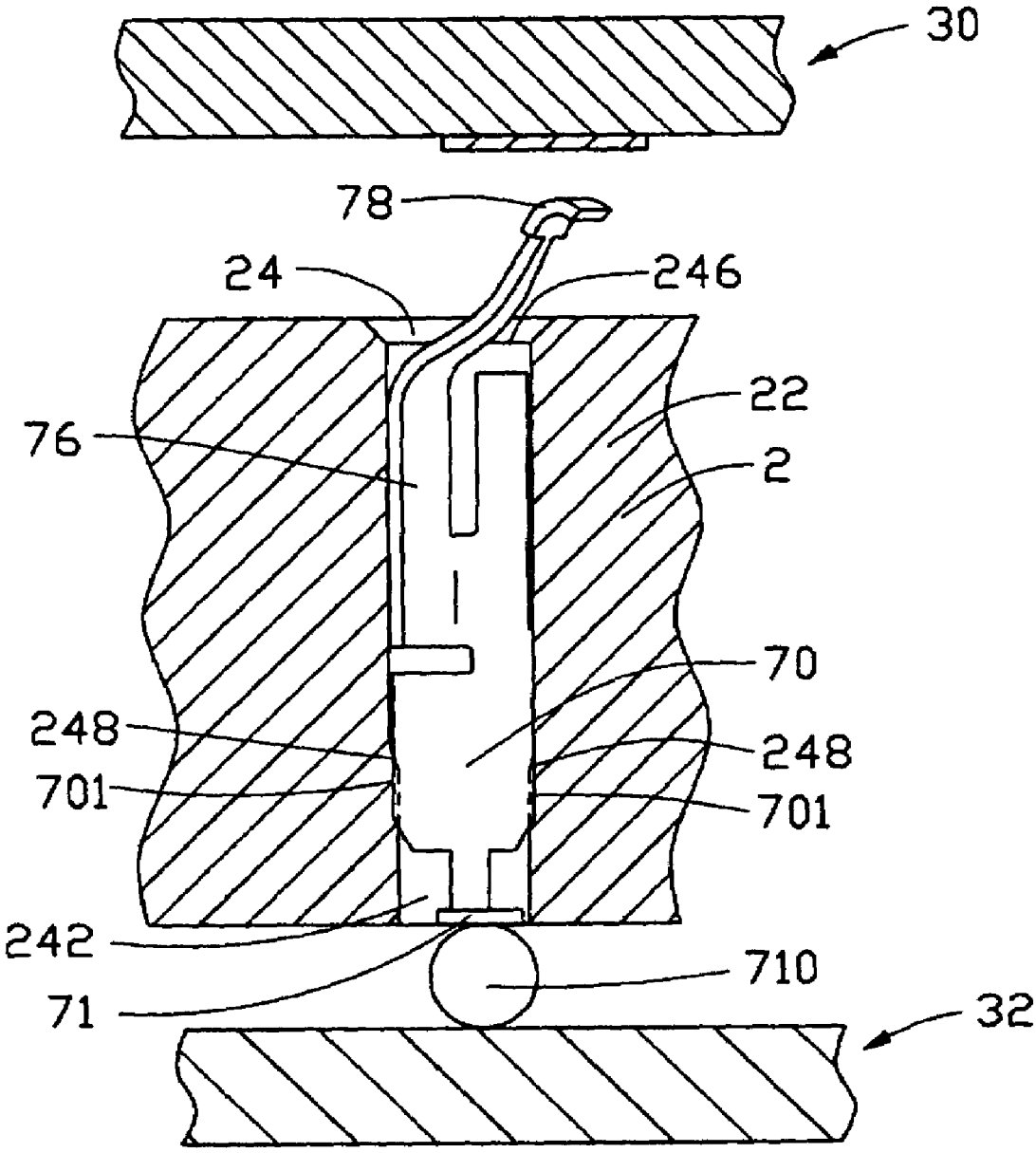
FIG. 3 is a simplified cross-section view of the socket connector of FIG. 2, shown with the integrated circuit and a printed circuit board.
Figure 4:
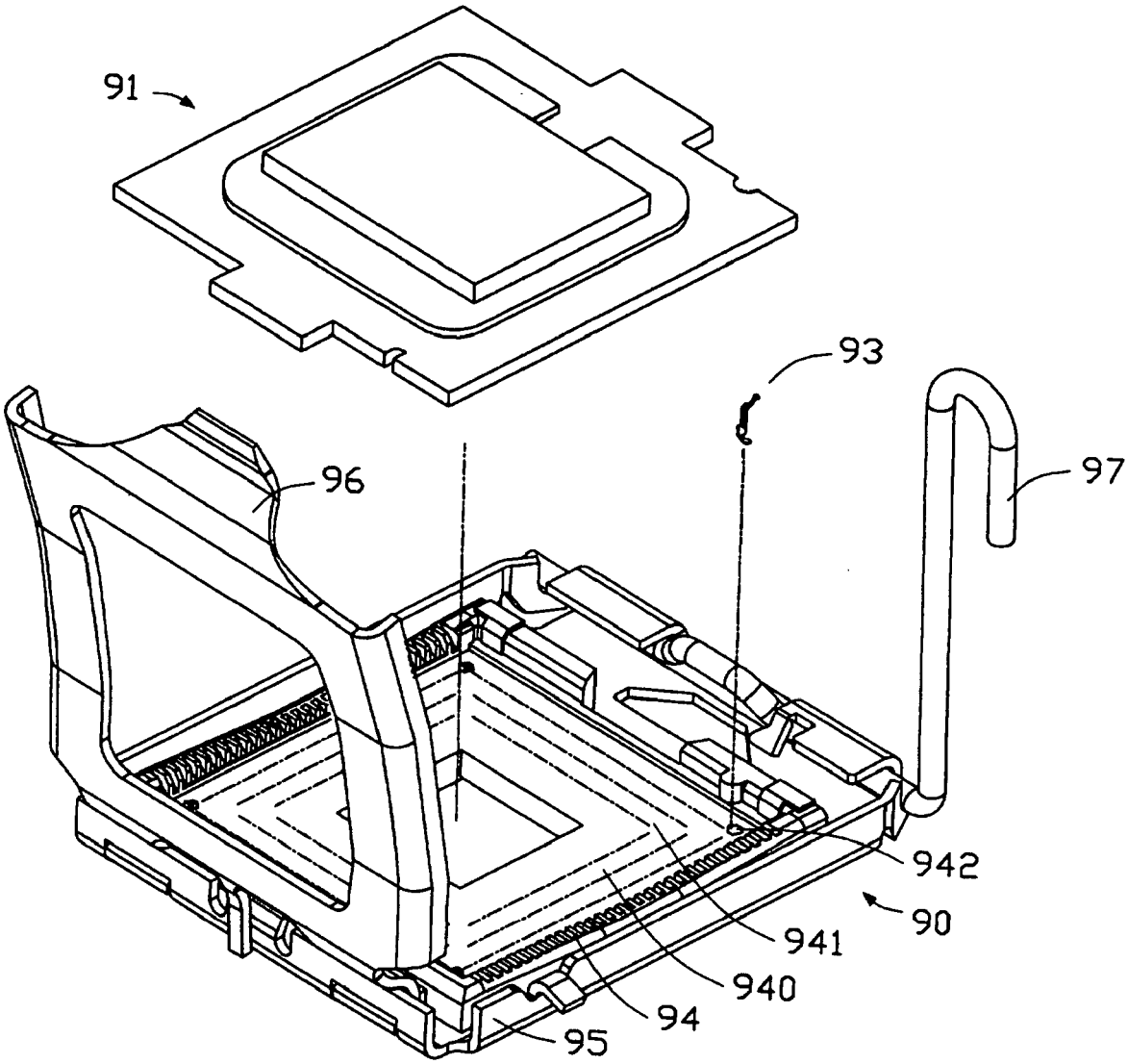
FIG. 4 (PRIOR ART)
FIG. 4 is an isometric view of a conventional socket connector, shown with an integrated circuit ready to be mounted onto the connector.
Figure 5:
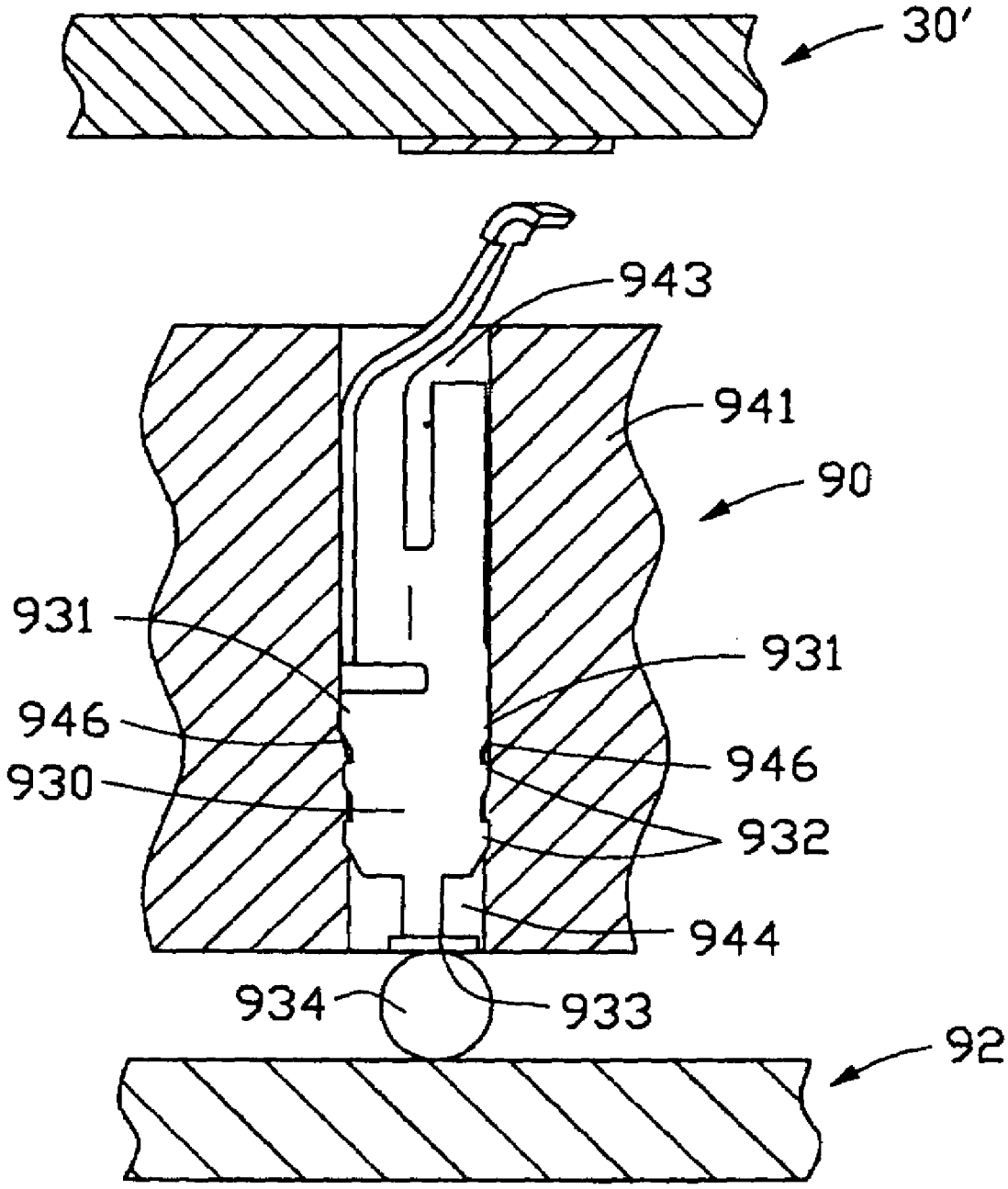
FIG. 5 (PRIOR ART)
FIG. 5 is a simplified cross-section view of the socket connector of FIG. 4, shown with the integrated circuit and a printed circuit board.

Referring to FIGS. 1 and 3, a socket connector 1 in accordance with a preferred embodiment of the present invention is adapted to electrically connect an integrated circuit (IC) 30 to a printed circuit board (PCB) 32 (shown in FIG. 3). The socket connector 1 comprises an insulative housing 2, a multiplicity of conductive terminals 7 received in the housing 2, a stiffening body 4 surrounding the housing 2, a load plate 6 pivotably assembled with one end of the stiffening body 4, and a load lever 5 pivotably attached to the other end of the stiffening body 4. The housing 2 defines a recessed area 20 for receiving the IC 30 therein, and the recessed area 20 forms a bottom wall 22. The housing defines a plurality of passageways 24 through the bottom wall 22 for accommodating corresponding terminals 7 therein. Each passageway 24 forms a step 248 for dividing the passageway into an upper wider receiving channel 246 and a lower narrower interfering channel 242.

Figure 2:
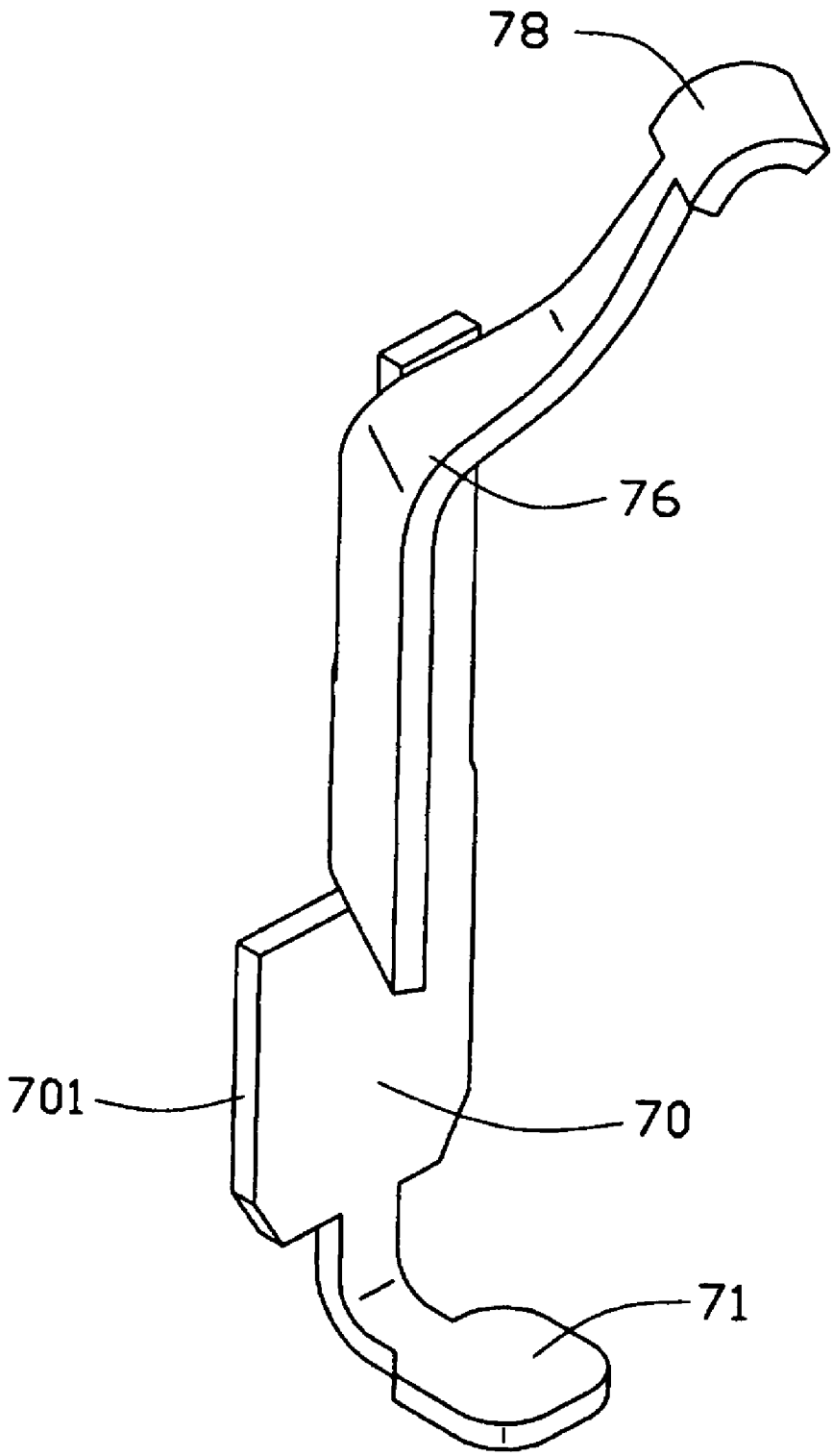
FIG. 2 is an enlarged isometric view of a conductive terminal of the socket connector.

Referring to FIGS. 2–3, the terminal 7 is formed by stamping from a conductive strip and includes a fastening portion 70, a spring arm 76 extending from the fastening portion 70, a solder portion 71 extending from and perpendicular to the fastening portion 70. The spring arm 76 forms a contacting end 78 at a distal end thereof. The fastening portion 70 further defines a plurality of straight interfering sides 701. A solder ball 710 is attached to the solder portion 71.

Referring to FIG. 3, the distance from one of two straight interfering sides 701 to the other is greater than the width of the interfering channel 242 but smaller than the width of the receiving channel 246. When the terminal 7 is installed into the housing 2 via the corresponding passageway 24, the terminal 7 is firmly positioned in corresponding passageway 24 by virtue of the interfering force between the two straight interfering sides 701 and the interfering channel 242. After the terminal 7 is positioned in the housing 2, the contacting end 78 extends out of the passageway 24 for connecting to the IC 30, and the solder ball 710 is soldered on the PCB 32. Thus, the socket connector 1 is sandwiched between the IC 30 and the PCB 32, and the IC 30 is accordingly electrically connected to the PCB 32.

As the terminal 7 is interferingly positioned in the passageway 24 by the two straight interfering sides and the interfering channel 242, the interfering force is pure friction along a vertical direction. And while the housing 2 is shaken by an improper exterior force, the terminal 7 can slide smoothly in the passageway 24 once the pure friction is conquered, which can protect the connection between the solder ball 710 and the PCB 32 and the connection between the solder portion 71 and the solder ball 710.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A socket connector for electrically connecting an integrated circuit to a printed circuit board comprising:

an insulative housing defining a plurality of passageways therethrough, each passageway defining a step therein for dividing the passageway into an upper receiving channel and a lower interfering channel;

a multiplicity of conductive terminals accommodating in the passageways, each terminal having a fastening portion defining a pair of straight interfering sides;

wherein a distance from one of the straight interfering sides to the other is greater than a width of the interfering channel and the terminal is positioned in the passageway by pure friction provided by the two straight interfering sides and the inner sides of interfering channel along a vertical direction;

wherein the terminal further comprises a solder portion extending from and perpendicular to the fastening portion;

wherein the socket connector includes a stiffening body surrounding the housing, a load plate pivotably assembled with an end of the stiffening body, and a load lever pivotably attached to the another end of the stiffening body;

wherein during up-and-down movement of the fastening portion in the receiving channel and the interfering channel, no interference occurs in the receiving channel but and interference occurs between the fastening portion and the interfering channel, so as to allow some floated movement of the contact in the passageway.

2. The socket connector as described in claim 1, wherein the distance between the two straight interfering sides is smaller than a width of the receiving channel.

3. The socket connector as described in claim 1, wherein the receiving channel is wider than the interfering channel in a direction perpendicular to the insertion of the terminal.

4. The socket connector as described in claim 1, wherein the solder portion is attached with a solder ball for connecting to the printed circuit board.

* * * * *